US008070986B2

(12) United States Patent
Heo et al.

(10) Patent No.: US 8,070,986 B2
(45) **Date of Patent: *Dec. 6, 2011**

(54) SILVER PASTE FOR FORMING CONDUCTIVE LAYERS

(75) Inventors: Soon Yeong Heo, Daegu (KR); Seong Sil Park, Daegu (KR); Seung Jun Han, Kyungsangnam-do (KR); Hyun Myung Jang, Pohang-si (KR)

(73) Assignee: Exax Inc., Gumi-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/916,954

(22) PCT Filed: May 25, 2007

(86) PCT No.: PCT/KR2007/002533

§ 371 (c)(1), (2), (4) Date: Nov. 16, 2009

(87) PCT Pub. No.: WO2008/093913

PCT Pub. Date: Aug. 7, 2008

(65) Prior Publication Data

US 2010/0193751 A1 Aug. 5, 2010

(30) Foreign Application Priority Data

Jan. 30, 2007 (KR) ..... 10-2007-0009179

(51) Int. Cl.
*H01B 1/22* (2006.01)

(52) U.S. Cl. ..... 252/514

(58) Field of Classification Search ..... 252/514; 106/1.19

See application file for complete search history.

(56) References Cited

U.S. PATENT DOCUMENTS

| | | | | |
|---|---|---|---|---|
| 2006/0289837 | A1* | 12/2006 | McNeilly et al. | 252/500 |
| 2008/0020572 | A1* | 1/2008 | Wu et al. | 438/686 |
| 2010/0021704 | A1* | 1/2010 | Yoon et al. | 428/209 |

FOREIGN PATENT DOCUMENTS

| | | |
|---|---|---|
| JP | 61-062558 | * 3/1986 |
| JP | 05-311103 | * 11/1993 |
| JP | 2005-293851 | * 10/2005 |

(Continued)

OTHER PUBLICATIONS

"International Search Report" for PCT/KR2007/002533, Korean Intellectual Property Office, Oct. 25, 2007, 2 page, Daejeon, Republic of Korea.

"Written Opinion" for PCT/KR2007/002533, Korean Intellectual Property Office, Oct. 25, 2007, 4 pages, Daejeon, Republic of Korea.

(Continued)

*Primary Examiner* — Mark Kopec

(74) *Attorney, Agent, or Firm* — Elizabeth Eunjoo Kim; Rauschenbach Patent Law Group

(57) ABSTRACT

The present invention provides a silver paste for forming electrically conductive pattern comprising 0.1 to 60 wt % of a silver C0 to C12 aliphatic carboxylate; 1 to 80 wt % of silver powder; 0.1 to 15 wt % of a binder; and a residual organic solvent.

The silver paste composition according to the present invention has advantages in that it produces micro-structures of layers denser than those conventional metal pastes do; shows characteristics of a much lower electric resistance even with a relatively small thickness or a small line width, as compared with the electrically conductive pattern formed from a conventional paste; and allows heat treatment at a very low temperature even without the use of expensive nano-sized metal particles.

7 Claims, 1 Drawing Sheet

FOREIGN PATENT DOCUMENTS

| | | | | |
|---|---|---|---|---|
| JP | 18-183072 | A | | 7/2006 |
| JP | 2007-242912 | A | * | 9/2007 |
| KR | 10-1997-0076901 | A | | 12/1997 |
| KR | 10-1999-0056608 | A | | 7/1999 |
| KR | 10-2006-0030638 | A | | 4/2006 |

OTHER PUBLICATIONS

"International Preliminary Report" for PCT/KR2007/002533, Korean Intellectual Property Office, Aug. 4, 2009, 5 pages, Daejeon, Republic of Korea.

* cited by examiner

[Fig. 1]
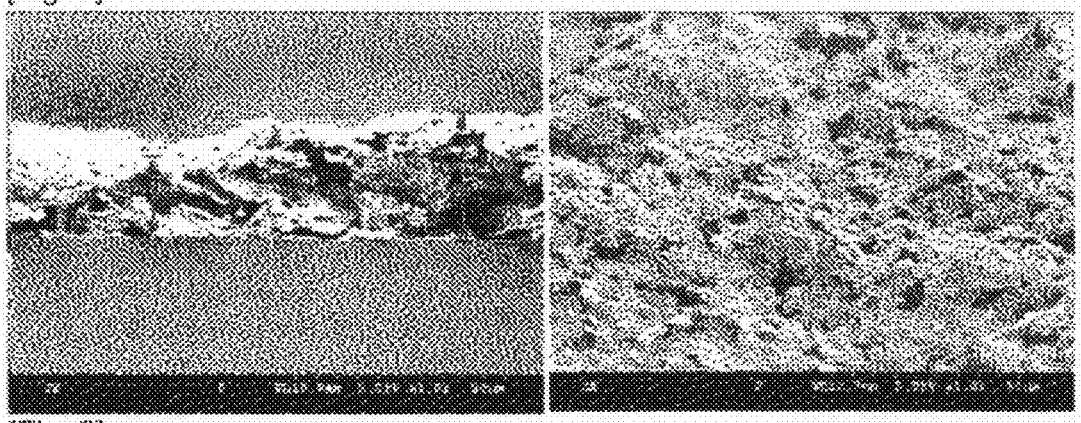
[Fig. 2]
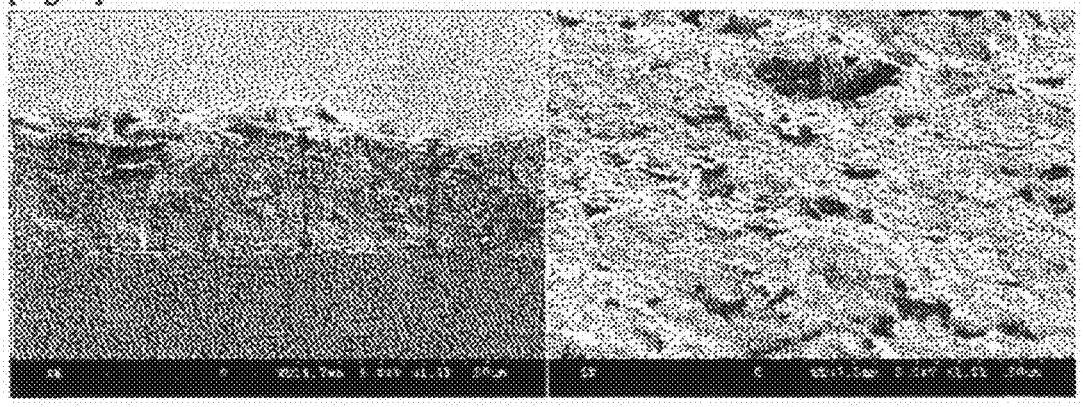

SILVER PASTE FOR FORMING CONDUCTIVE LAYERS

TECHNICAL FIELD

The present invention relates to a silver paste for forming an electrically conductive layer. The electrically conductive layers are formed as electrically conductive patterns in flat panel displays such as an LCD (liquid crystal display) and a PDP (plasma display panel), electrodes of a touch screen, PAD electrodes of a flat fluorescent lamp (FFL) backlight, electrodes of a flexible PCB, and RFID antennas.

BACKGROUND ART

The formation of an electrically conductive pattern used for a display usually includes a step for forming a continuous pattern with an appropriate ink or paste by a contact or a non-contact printing method and a step for post-treatment to fix it on a substrate. In some cases, a subtractive/additive process further comprising a step of etching may be employed.

A number of studies to ink for forming a pattern by using an MOD material have been made ever since Vest, R. W. tested inks made of MOD material (IEEE Transactions on Components, Hybrids and Manufacturing Technology, 12(4), 545-549, 1987).

Herein, MOD (metallo-organic decomposition) material means an organic metal compound, which is decomposed and metallized at a temperature lower than the melting point of a metal.

U.S. Pat. No. 6,878,184 (issued to Kovio, Inc.) disclosed a technology for ink having nanoparticles formed from an MOD and a redwing agent (for example, aldehyde). However, this technology requires a stringent reaction condition, and a large amount of expensive MOD material. Further, the formed nanoparticles cannot provide sufficient electrical conductivity.

The advantage of MOD inks and inks made of suspended nanoparticles has relatively low metallization temperatures. However, they are disadvantageous in that they require high cost, and the electrical conductivity is remarkably reduced, as compared with a bulk metal.

International Patent Publication WO98-37133 (issued to Kydd, et al.) suggested a composite composition consisting of a MOD material and a particulate metal for screen printing ink by combining high electrical conductivity of a bulk metal and lower metallization temperature of MOD material. However, this patent does not disclose a printing ink of which the metallization temperature is low enough to be applied on a plastic substrate. Further, since the MOD material and the particulate metal are in the form of particles, further steps for finely pulverizing them with a vehicle by a ball mill are required to prepare the ink. The ink prepared by the above method has poor adaptability to various occasions, and should be used as a manufacturer prescribes.

DISCLOSURE OF INVENTION

Technical Problem

It is an object of the present invention to provide a silver paste for forming an electrically conductive layer having excellent electrical conductivity, It is another object of the present invention to provide a silver paste, which can be economically prepared and has high adaptability to various sites.

It is the other object of the present invention to provide a silver paste, which forms an electrical electrically conductive layer through metallization at a relatively low temperature,

Technical Solution

The present invention provides a silver paste for forming electrically conductive pattern comprising 0.1 to 60 wt % of a silver C0 to C12 aliphatic carboxylate; 1 to 80 wt % of silver powder; 0.1 to 15 wt % of a binder; and a residual organic solvent.

The silver aliphatic carboxylate may be linear or branched, or substituted by an amino group, a nitro group or a hydroxy group.

The silver aliphatic carboxylate is preferably 0.1 to 10 wt %, most preferably 0.1 to 4 wt % of the total paste. Too much silver aliphatic carboxylate causes higher cost and hinders flow of the paste during coating and metallizing, but too little silver aliphatic carboxylate causes less conductivity and fast flow of the paste during coating and metallizing. The silver aliphatic carboxylate is preferably saturated or has one or two double bonds. For example, it includes silver maleate, silver malonate, silver succinate, silver acetate, silver malate, silver methacrylate, silver propionate, silver sorbate, silver citrate, silver undecylenate, silver neo-decanate, silver oleate, silver oxalate, silver formate, silver gluconate, or a mixture thereof, preferably silver citrate, silver oxalate, silver formate, silver maleate or a mixture thereof.

The silver paste of the present invention can be metallized or heat-treated below 280° C., preferably 80 to 280° C. The silver paste of the present invention can be employed in environments of low metallizing temperature. For example, it can be applied on plastic substrate.

As binder, broadly, polymeric natural or synthetic compound can be adopted. Specifically, urethane-, acryl- and epoxy-based binders can be used, and the amount of the binder used is generally 0.1 to 13 w % of the paste, preferably 1 to 13 w %. The conductivity becomes poor above the range, whereas the binding power becomes lower below the range. One liquid or two liquid type of urethane- and epoxy-based thermosetting binders may be used The organic solvent is selected from the group consisting of a vehicle for modulating viscosity, a reactive organic solvent and a mixture thereof.

The organic solvent is C1 to C4 aliphatic alcohol having a mono- to tri-valent hydroxyl group, C2 to C8 alkyl ether of the aliphatic alcohol or C2 to C8 alkyl ester of the aliphatic alcohol, for example, butylcarbitol acetate, butylcarbitol, ethylcarbitol, ethylcarbitol acetate, terpineol, texanol, menthanol, isoamyl acetate, methanol, ethanol and a mixture thereof.

The reactive organic solvent is not a simple inertial vehicle but an organic solvent having a heteroatom P, S, O or N, such as a ketone group, a mercapto group, a carboxylic group, an aniline group, an ether group, a sulfite group or the like to form a chelate or a complex with silver or silver carboxylate. The reactive organic solvent is, preferably, amine substituted by one or more C1 to C6 aliphatic group which may be substituted by hydroxyl, or a C1 to C16 linear or branched aliphatic thiol. The reactive organic solvent is more preferably methylamine, ethylamine, isopropylamine, monoethanolamine, diethanolamine, triethanolamine, or a linear saturated aliphatic thiol containing 5 to 14 carbon atoms, most preferably ethylamine.

The silver paste of the present invention means silver suspended in a solution and the viscosity thereof can be controlled according to the purpose of use. This silver paste can be employed for various printing methods such as gravure, flexo, screen, rotary, dispenser, and offset printings, after modulating the viscosity and adding an appropriate binder. The viscosity for coating is in the range of 1 to 70,000 cPs. In the case of silkscreen, the viscosity is in the range of 10,000 to 35000 cPs, preferably 10,000 to 20,000 cPs.

The silver powder is preferably 1 to 60 wt % of the total paste. The silver powder has an average particle diameter of micrometer scale, for example, in the range of 0.1 to 10 micrometers, most preferably in the range of 1 to 5 micrometers. The silver powder is preferably plate-like.

Advantageous Effects

The silver paste composition according to the present invention has advantages in that it produces micro-structures of layers denser than those conventional metal pastes do; shows characteristics of a much lower electric resistance even with a relatively small thickness or a small line width, as compared with the electrically conductive pattern formed from a conventional paste; and allows heat treatment at a very low temperature even without the use of expensive nano-sized metal particles. Further, the silver paste of the present invention can be applied not only on a glass substrate but on a plastic substrate such as PET, particularly on a polyimide substrate used as a substrate for flexible PCB. The silver paste also can be adopted in flexible display of a next generation, a torch panel, flexible PCB, RFID or the like in the viewpoint of cost effectiveness.

BRIEF DESCRIPTION OF THE DRAWINGS

FIG. 1 shows an SEM image of an electrically conductive layer on a glass substrate of a conventional silver paste made from silver powder and a vehicle;

FIG. 2 shows an SEM image of an electrically conductive layer on a glass substrate of the silver paste composition of the present invention

BEST MODE FOR CARRYING OUT THE INVENTION

Hereinbelow, the present invention will be described with reference to Examples. These Examples are provided only for the purpose of illustrating the present invention, and it should not be construed that the scope of the present invention be limited thereto. As silver powder, a plate-like silver powder having a diameter 50 times bigger of the thickness, and an average particle diameter of 3 micrometers, is used. As a binder, a blend of KER3001 (trade name) epoxy-based resin manufactured by Kumho P&B Chemicals Inc, (Korea) and 2-ethylimidazole manufactured by Aldrich Chemical Co. as a curing agent in a ratio of 95:5, was used. In the Examples, the silver aliphatic carboxylate was added in the amounts of 0.4 g, 0.9 g, 1.7 g and 3.4 g, respectively. The pure silver of the silver aliphatic carboxylate is approximately 0.5, 1, 2 and 4 wt % of the total silver respectively based on silver oxalate or silver formate. The silver ink as used herein means the same as the silver solution.

Comparative Example 1

100 g of a paste composition is prepared by mixing thoroughly 60 g of a plate-like silver powder (having an average particle diameter of 3 micrometers which is about 50 times bigger of the thickness), 14.38 g of normal terpineol, 2.5 g of butylcarbitol acetate, and a residual amount of ethanol. The paste composition was coated on a glass substrate, heat-treated at 130° C., 200° C. and 250° C., respectively, and measured on its line resistances using a 2-probe device. The results thereof are shown in Table 1. A silver film coated on the glass substrate and heat-treated at 200° C. was cut for comparison with those of paste of the present invention, and the cross-section and surface thereof were observed by SEM. The images thereof are shown in FIG. 1.

Example 1

50 mmol of formic acid is dissolved in 50 mL of methanol. 50 mmol NaOH dissolved in 50 mL, water is added slowly to the formic acid solution prepared while stirring to form sodium formate. 50 mmol silver nitrate dissolved in 50 mL water is added to the sodium formate, and then white precipitate is formed first. The precipitates were sufficiently washed with water to remove unreacted silver nitrate and NaOH, and then filtered, and the residue was washed with methanol again, and dried at ambient temperature to prepare silver formate.

0.4 g of the prepared silver formate powder, 59.7 g of plate-like silver powder having an average particle size of 3 micrometers, 14.4 g of normal terpineol, 2.5 g of butylcarbitol acetate, 4 g of an epoxy binder, and a residual amount of ethanol was put together and mixed to prepare 100 g of a paste composition.

The paste composition was screen printed on a glass substrate, a PET substrate, or a polyimide substrate, and heat-treated at 130° C., 200° C., and 250° C., respectively, and characterized by measuring the line resistance using a 2-probe apparatus. Separately, the silver film coated on the glass substrate was cut for comparison with those of the conventional pastes, and the cross-section and surface thereof were observed by SEM. The viscosity of the coated film, the adhesive power and electric resistance of the heat-treated coated film are summarized in Table 1.

Example 2

Using the silver formate powder prepared from Example 1, Example 2 is carried out the same way as Example 1 except that 0.8 g of the silver formate powder and 59.4 g of the plate-like silver powder were used. The viscosity of the coated film, the adhesive power and electric resistance of the heat-treated film are summarized in Table 1.

Example 3

Using the silver formate powder prepared from Example 1, Example 3 is carried out the same way as Example 1 except that 1.7 g of the silver formate powder and 58.8 g of the plate-like silver powder were used. The viscosity of the coated film, the adhesive power and electric resistance of the heat-treated film are summarized in Table 1.

Example 4

Using the silver formate powder prepared from Example 1, Example 4 is carried out the same way as Example 1 except that 3.4 g of the silver formate powder and 57.6 g of the plate-like silver powder were used. The viscosity of the coated film, the adhesive power and electric resistance of the heat-treated film are summarized in Table 1

Example 5

Silver oxalate is prepared in the same way as Example 1 except that oxalic acid is used instead of formic acid. Example 5 is carried out the same way as Example 1 except that 0.4 g of the silver oxalate powder thus prepared and 59.4 g of the plate-like silver powder were used. The viscosity of the coated film, the adhesive power and electric resistance of the heat-treated film are summarized in Table 1

Example 6

Example 6 is carried out the same way as Example 1 except that 0.8 g of the silver oxalate powder and 59.4 g of the plate-like silver powder were used. The viscosity of the coated film, and the adhesive power and electric resistance of the heat-treated film are summarized in Table 1

Example 7

Example 7 is carried out the same way as Example 5 except that 1.7 g of the silver oxalate powder and 58,8 g of the plate-like silver powder were used. The SEM images for section and for surface of the film heat-treated at 200° C. are shown in FIG. 2. The micro-structure of FIG. 2 is denser than that of FIG. 1.

Example 8

Example 8 is carried out the same way as Example 5 except that 3.4 g of the silver oxalate powder and 57,6 g of the plate-like silver powder were used.

Example 9

Silver citrate is prepared in the same way as Example 1 except that citric acid is used instead of formic acid. Example 9 is carried out the same way as Example 1 except that 0,4 g of the silver citrate powder thus prepared and 59.7 g of the plate-like silver powder were used. The viscosity of the coated film, and the adhesive power and electric resistance of the heat-treated film are summarized in Table 2

Example 10

Example 10 is carried out the same way as Example 1 except that 0.8 g of the silver citrate powder thus prepared and 59.4 g of the plate-like silver powder were used.

Example 11

Example 11 is carried out the same way as Example 1 except that 1.7 g of the silver citrate powder thus prepared and 58.8 g of the plate-like silver powder were used.

Example 12

Example 12 is carried out the same way as Example 1 except that 3.4 g of the silver citrate powder thus prepared and 57.6 g of the plate-like silver powder were used.

Example 13

Silver malate is prepared in the same way as Example 1 except that malic acid is used instead of formic acid. Example 13 is carried out the same way as Example 1 except that 0.4 g of the silver malate powder thus prepared and 59.7 g of the plate-like silver powder were used. The viscosity of the coated film, and the adhesive power and electric resistance of the heat-treated film are summarized in Table 2

Example 14

Example 14 is carried out the same way as Example 1 except that 0.8 g of the silver malate powder thus prepared and 59.4 g of the plate-like silver powder were used.

Example 15

Example 15 is carried out the same way as Example 1 except that 1.7 g of the silver malate powder thus prepared and 58.8 g of the plate-like silver powder were used.

Example 16

Example 16 is carried out the same way as Example 1 except that 3.4 g of the silver malate powder thus prepared and 57.6 g of the plate-like silver powder were used.

TABLE 1

| Silver formate, Silver oxalate | | 130° C. | | | 200° C. | | | 250° C. | | |
|---|---|---|---|---|---|---|---|---|---|---|
| | | resistance | Viscosity (cPs) | hardness | resistance | Viscosity (cPs) | hardness | resistance | Viscosity (cPs) | hardness |
| Comp. Ex. 1 | glass | 66.271 Ω | 15,000 | 1H | 7.271 Ω | 15,000 | 3H | 1.796 Ω | 15,000 | 7H |
| Ex. 1 | glass | 1.208 Ω | 16,200 | 9H | 1.116 Ω | 16,200 | 9H | 0.967 Ω | 16,200 | 9H |
| | PET | 1.192 Ω | 16,200 | 9H | — | 16,200 | 9H | — | 16,200 | 9H |
| | polyimide | 1.198 Ω | 16,200 | 9H | 1.063 Ω | 16,200 | 9H | 0.884 Ω | 16,200 | 9H |
| Ex. 2 | glass | 0.889 Ω | 16,880 | 9H | 0.733 Ω | 16,880 | 9H | 0.754 Ω | 16,880 | 9H |
| | PET | 0.885 Ω | 16,880 | 9H | — | 16,880 | 9H | — | 16,880 | 9H |
| | polyimide | 0.882 Ω | 16,880 | 9H | 0.539 Ω | 16,880 | 9H | 0.521 Ω | 16,880 | 9H |
| Ex. 3 | glass | 0.722 Ω | 17,560 | 9H | 0.552 Ω | 17,560 | 9H | 0.509 Ω | 17,560 | 9H |
| | PET | 0.718 Ω | 17,560 | 9H | — | 17,560 | 9H | — | 17,560 | 9H |
| | polyimide | 0.715 Ω | 17,560 | 9H | 0.544 Ω | 17,560 | 9H | 0.539 Ω | 17,560 | 9H |
| Ex. 4 | glass | 0.884 Ω | 18,200 | 9H | 0.864 Ω | 18,200 | 9H | 0.503 Ω | 18,200 | 9H |
| | PET | 0.877 Ω | 18,200 | 9H | — | 18,200 | 9H | — | 18,200 | 9H |
| | polyimide | 0.885 Ω | 18,200 | 9H | 0.837 Ω | 18,200 | 9H | 0.503 Ω | 18,200 | 9H |

TABLE 1-continued

| Silver formate, Silver oxalate | | 130° C. resistance | 130° C. Viscosity (cPs) | 130° C. hardness | 200° C. resistance | 200° C. Viscosity (cPs) | 200° C. hardness | 250° C. resistance | 250° C. Viscosity (cPs) | 250° C. hardness |
|---|---|---|---|---|---|---|---|---|---|---|
| Ex. 5 | glass | 2.645 Ω | 16,200 | 9H | 1.105 Ω | 16,200 | 9H | 0.427 Ω | 16,200 | 9H |
| | PET | 2.632 Ω | 16,200 | 9H | — | 16,200 | 9H | — | 16,200 | 9H |
| | polyimide | 2.662 Ω | 16,200 | 9H | 1.070 Ω | 16,200 | 9H | 0.422 Ω | 16,200 | 9H |
| Ex. 6 | glass | 1.005 Ω | 16,880 | 9H | 0.362 Ω | 16,880 | 9H | 0.286 Ω | 16,880 | 9H |
| | PET | 0.998 Ω | 16,880 | 9H | — | 16,880 | 9H | — | 16,880 | 9H |
| | polyimide | 1.011 Ω | 16,880 | 9H | 0.454 Ω | 16,880 | 9H | 0.276 Ω | 16,880 | 9H |
| Ex. 7 | glass | 0.762 Ω | 17,560 | 9H | 0.476 Ω | 17,560 | 9H | 0.269 Ω | 17,560 | 9H |
| | PET | 0.768 Ω | 17,560 | 9H | — | 17,560 | 9H | — | 17,560 | 9H |
| | polyimide | 0.764 Ω | 17,560 | 9H | 0.352 Ω | 17,560 | 9H | 0.261 Ω | 17,560 | 9H |
| Ex. 8 | glass | 0.952 Ω | 18,200 | 9H | 0.685 Ω | 18,200 | 9H | 0.405 Ω | 18,200 | 9H |
| | PET | 0.967 Ω | 18,200 | 9H | — | 18,200 | 9H | — | 18,200 | 9H |
| | polyimide | 0.954 Ω | 18,200 | 9H | 0.671 Ω | 18,200 | 9H | 0.397 Ω | 18,200 | 9H |

TABLE 2

| Silver citrate, Silver malate | | 130° C. resistance | 130° C. Viscosity (cPs) | 130° C. hardness | 200° C. resistance | 200° C. Viscosity (cPs) | 200° C. hardness | 250° C. resistance | 250° C. Viscosity (cPs) | 250° C. hardness |
|---|---|---|---|---|---|---|---|---|---|---|
| Ex. 9 | glass | 0.436 Ω | 16,200 | 9H | 0.105 Ω | 16,200 | 9H | 0.198 Ω | 16,200 | 9H |
| | PET | 0.429 Ω | 16,200 | 9H | — | 16,200 | 9H | — | 16,200 | 9H |
| | polyimide | 0.477 Ω | 16,200 | 9H | 0.270 Ω | 16,200 | 9H | 0.200 Ω | 16,200 | 9H |
| Ex. 10 | glass | 0.488 Ω | 16,880 | 9H | 0.311 Ω | 16,880 | 9H | 0.186 Ω | 16,880 | 9H |
| | PET | 0.509 Ω | 16,880 | 9H | — | 16,880 | 9H | — | 16,880 | 9H |
| | polyimide | 0.529 Ω | 16,880 | 9H | 0.295 Ω | 16,880 | 9H | 0.113 Ω | 16,880 | 9H |
| Ex. 11 | glass | 0.550 Ω | 17,560 | 9H | 0.285 Ω | 17,560 | 9H | 0.082 Ω | 17,560 | 9H |
| | PET | 0.570 Ω | 17,560 | 9H | — | 17,560 | 9H | — | 17,560 | 9H |
| | polyimide | 0.591 Ω | 17,560 | 9H | 0.269 Ω | 17,560 | 9H | 0.083 Ω | 17,560 | 9H |
| Ex. 12 | glass | 0.611 Ω | 18,200 | 9H | 0.261 Ω | 18,200 | 9H | 0.096 Ω | 18,200 | 9H |
| | PET | 0.632 Ω | 18,200 | 9H | — | 18,200 | 9H | — | 18,200 | 9H |
| | polyimide | 0.652 Ω | 18,200 | 9H | 0.245 Ω | 18,200 | 9H | 0.110 Ω | 18,200 | 9H |
| Ex. 13 | glass | 2.645 Ω | 16,200 | 9H | 1.105 Ω | 16,200 | 9H | 0.427 Ω | 16,200 | 9H |
| | PET | 2.632 Ω | 16,200 | 9H | — | 16,200 | 9H | — | 16,200 | 9H |
| | polyimide | 2.662 Ω | 16,200 | 9H | 1.070 Ω | 16,200 | 9H | 0.422 Ω | 16,200 | 9H |
| Ex. 14 | glass | 1.005 Ω | 16,880 | 9H | 0.362 Ω | 16,880 | 9H | 0.286 Ω | 16,880 | 9H |
| | PET | 0.998 Ω | 16,880 | 9H | — | 16,880 | 9H | — | 16,880 | 9H |
| | polyimide | 1.011 Ω | 16,880 | 9H | 0.454 Ω | 16,880 | 9H | 0.276 Ω | 16,880 | 9H |
| Ex. 15 | glass | 0.762 Ω | 17,560 | 9H | 0.476 Ω | 17,560 | 9H | 0.269 Ω | 17,560 | 9H |
| | PET | 0.768 Ω | 17,560 | 9H | — | 17,560 | 9H | — | 17,560 | 9H |
| | polyimide | 0.764 Ω | 17,560 | 9H | 0.352 Ω | 17,560 | 9H | 0.261 Ω | 17,560 | 9H |
| Ex. 16 | glass | 0 952 Ω | 18,200 | 9H | 0.685 Ω | 18,200 | 9H | 0.405 Ω | 18,200 | 9H |
| | PET | 0.967 Ω | 18,200 | 9H | — | 18,200 | 9H | — | 18,200 | 9H |
| | polyimide | 0.954 Ω | 18,200 | 9H | 0.671 Ω | 18,200 | 9H | 0.397 Ω | 18,200 | 9H |

The invention claimed is:

1. A silver paste for forming an electrically conductive layer consisting essentially of 0.1 to 60 wt % of a silver C0 to C12 aliphatic carboxylate powder; 1 to 80 wt % of silver powder; 0.1 to 15 wt % of a binder; and a residual organic solvent including a vehicle for modulating viscosity of the silver paste to at least about 10,000 cPs;

wherein the silver powder is plate-like; and wherein said silver paste additionally contains a reactive organic solvent.

2. A silver paste for forming an electrically conductive layer according to claim 1, wherein the silver powder has an average particle diameter in the range of 0.1 to 10 micrometers and the silver aliphatic carboxylate is selected from the group consisting of silver citrate, silver oxalate, silver formate and silver malate.

3. A silver paste for forming an electrically conductive layer according to claim 1 , wherein the vehicle for modulating viscosity is C1 to C4 aliphatic alcohol having a mono- to tri-valent hydroxyl group, C2 to C8 alkyl ether of the aliphatic alcohol or C2 to C8 alkyl ester of the aliphatic alcohol.

4. A silver paste for forming an electrically conductive layer according to claim 1, wherein the reactive organic solvent is selected from the group consisting of an amine substituted by one or more C1 to C6 aliphatic group and a linear or branched C1 to C16 aliphatic thiol.

5. A silver paste for forming an electrically conductive layer according to claim 1, wherein the reactive organic solvent is selected from the group consisting of methylamine, ethylamine, isopropylamine, monoethanolamine, diethanolamine, triethanolamine and a mixture thereof and the vehicle for modulating viscosity is selected from the group consisting of butylcarbitol acetate, butylcarbitol, ethylcarbitol, ethylcarbitol acetate, terpineol, texanol, menthanol, isoamyl acetate, methanol, ethanol and a mixture thereof.

6. A silver paste for forming an electrically conductive layer according to claim 5, wherein the binder is thermosetting and 1 to 13 w % of the total paste.

7. A silver paste for forming an electrically conductive layer according to claim 6, wherein the metallization temperature of the silver paste is 80° C. to 280° C.

* * * * *